US009254977B2

(12) United States Patent
Ito

(10) Patent No.: US 9,254,977 B2
(45) Date of Patent: Feb. 9, 2016

(54) IMAGE RECORDING APPARATUS

(71) Applicant: Tsuyoshi Ito, Nagoya (JP)

(72) Inventor: Tsuyoshi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/185,271

(22) Filed: Feb. 20, 2014

(65) Prior Publication Data

US 2014/0232061 A1 Aug. 21, 2014

Related U.S. Application Data

(63) Continuation of application No. 13/629,715, filed on Sep. 28, 2012, now Pat. No. 8,690,316.

(30) Foreign Application Priority Data

Nov. 28, 2011 (JP) ..... 2011-259571

(51) Int. Cl.

| | |
|---|---|
| ***B41J 13/10*** | (2006.01) |
| ***B65H 9/04*** | (2006.01) |
| ***B41J 13/00*** | (2006.01) |
| ***B41J 11/06*** | (2006.01) |

(52) U.S. Cl.

CPC . *B65H 9/04* (2013.01); *B41J 11/06* (2013.01); *B41J 13/00* (2013.01); *B41J 13/10* (2013.01)

(58) Field of Classification Search

USPC ..... 347/101, 104

See application file for complete search history.

(56) References Cited

U.S. PATENT DOCUMENTS

| | | | | |
|---|---|---|---|---|
| 6,616,316 | B2 | 9/2003 | Takayanagi et al. | |
| 6,896,432 | B2 | 5/2005 | Ohyama | |
| 7,232,269 | B2 | 6/2007 | Ohyama | |
| 8,690,316 | B2 * | 4/2014 | Ito | 347/104 |
| 2003/0025777 | A1 * | 2/2003 | Sugiyama | 347/104 |
| 2003/0048345 | A1 | 3/2003 | Matsumoto | |
| 2004/0126164 | A1 | 7/2004 | Ohyama | |
| 2005/0168557 | A1 | 8/2005 | Ohyama | |
| 2011/0001778 | A1 | 1/2011 | Kanda et al. | |
| 2012/0067942 | A1 | 3/2012 | Quehl | |
| 2013/0135389 | A1 | 5/2013 | Ito et al. | |
| 2013/0135409 | A1 | 5/2013 | Ito et al. | |
| 2013/0135413 | A1 | 5/2013 | Ito et al. | |

FOREIGN PATENT DOCUMENTS

JP 2000071532 A 3/2000

* cited by examiner

*Primary Examiner* — Huan Tran

(74) *Attorney, Agent, or Firm* — Banner & Witcoff, Ltd.

(57) ABSTRACT

An image recording apparatus includes a recording section which is provided over a transport passage for transporting a sheet in a transport direction and which has nozzles for discharging an ink onto the sheet; a platen which is provided under the recording section with the transport passage intervening therebetween and which has a plurality of ribs provided to support the sheet while being separated from each other in a widthwise direction of the transport passage perpendicular to the transport direction, the respective ribs protruding upwardly and extending in the transport direction; and a plurality of holding members which are provided to be positioned between the plurality of ribs in the widthwise direction of the transport passage over the platen on an upstream side in the transport direction from the nozzles and which abut against an upper surface of the sheet and press the sheet toward the platen.

15 Claims, 10 Drawing Sheets

IMAGE RECORDING APPARATUS

CROSS REFERENCE TO RELATED APPLICATION

The present application is a continuation application of U.S. patent application Ser. No. 13/629,715 filed Sep. 28, 2012, which claims priority from Japanese Patent Application No. 2011-259571, filed on Nov. 28, 2011. The disclosures of the above noted applications are hereby incorporated by reference in their entireties.

BACKGROUND OF THE INVENTION

1. Field of the Invention

The present invention relates to an image recording apparatus which is capable of recording an image on a sheet transported along a transport passage.

2. Description of the Related Art

An image recording apparatus, which is capable of recording an image on a sheet, is provided with a transport passage for the sheet therein in most cases. In the image recording apparatus, the sheet is interposed by roller pairs, and thus the sheet is transported along the transport passage. For example, an ink-jet printer is known as an image recording apparatus which is provided with a recording section for recording an image by discharging inks from an upward position to the sheet, and a platen provided under or below the recording section with a transport passage intervening therebetween for supporting the sheet.

In order to avoid the floating of the sheet during the image recording, Japanese Patent Application Laid-open No. 2000-71532 discloses an ink-jet recording apparatus in which the sheet is curved in a wavy form (wavy shape) in the direction (hereinafter simply referred to as "widthwise direction") perpendicular to the transport direction so that the strength is strengthened with respect to the bending of the sheet in the transport direction.

In the case of the ink-jet recording apparatus disclosed in Japanese Patent Application Laid-open No. 2000-71532, the sheet is curved by being interposed between a platen 11 which has ribs 13 and recesses 15 and a sheet holding plate 12 which has projections 16. The projections 16 are arranged while being aligned in the widthwise direction. Therefore, the sheet is curved approximately simultaneously at all portions in the widthwise direction at the timing at which the downstream end in the transport direction arrives at the sheet holding plate 12. In this situation, in order to curve the portions disposed in the vicinity of the center of the sheet in the widthwise direction, it is necessary that the both end sides of the sheet should be pulled up to the center respectively. However, a large force is required to pull the sheet portions up to the center in the state in which the both end sides of the sheet are pressed by the projections 16. Therefore, the portions, which are disposed in the vicinity of the center of the sheet in the widthwise direction, are hardly curved as compared with the portions disposed on the both end sides, wherein the amplitude of the formed wave is small. As described above, in the case of the conventional structure or arrangement, a problem arises, for example, such that the amplitude of the wave formed by the sheet is dispersed in the widthwise direction. Usually, it is possible to raise the accuracy of the image recording when the amplitude of the wave formed by the sheet is less dispersed.

SUMMARY OF THE INVENTION

The present invention has been made taking the foregoing problem into consideration, an object of which is to provide a structure or arrangement capable of performing the highly accurate image recording by decreasing the dispersion of the amplitude of the wave formed by a sheet.

According to first aspect of the present invention, there is provided an image recording apparatus which is configured to record an image on a sheet; the apparatus including: a recording section which is provided over a transport passage for transporting the sheet in a transport direction and which has nozzles for discharging an ink onto the sheet to record the image; a platen which is provided under the recording section with the transport passage intervening therebetween and which has a plurality of ribs provided to support the sheet while being separated from each other in a widthwise direction of the transport passage perpendicular to the transport direction, the respective ribs protruding upwardly and extending in the transport direction; and a plurality of holding members which are provided to be positioned between the plurality of ribs in the widthwise direction of the transport passage over the platen on an upstream side in the transport direction from the nozzles and which abut against an upper surface of the sheet and press the sheet toward the platen; wherein the holding members have abutment portions which are capable of abutting against the sheet respectively, at least parts of the respective abutment portions being positioned downwardly as compared with upper ends of the plurality of ribs; the plurality of ribs include a first rib and a second rib which is provided at a position separated farther from a center of the transport passage as compared with the first rib in the widthwise direction of the transport passage; the plurality of holding members include a first holding member and a second holding member which is provided at a position separated farther from the center of the transport passage as compared with the first holding member in the widthwise direction of the transport passage; and at least one set of the plurality of ribs and the plurality of holding members are constructed in the transport direction so that an upstream end of the first rib is positioned at the same position as that of an upstream end of the second rib or positioned on the upstream side as compared with the upstream end of the second rib, or an abutment portion of the first holding member is positioned at the same position as that of an abutment portion of the second holding member or positioned on the upstream side as compared with the abutment portion of the second holding member.

According to second aspect of the present invention, there is provided an image recording apparatus which is configured to record an image on a sheet, the apparatus including: a recording section which is provided over a transport passage for transporting the sheet in a transport direction and which has nozzles for discharging an ink onto the sheet to record the image; a platen which is provided under the recording section with the transport passage intervening therebetween and which has a plurality of ribs provided to support the sheet while being separated from each other in a widthwise direction of the transport passage perpendicular to the transport direction, the respective ribs protruding upwardly and extending in the transport direction; and a plurality of holding members which are provided to be positioned over the platen on an upstream side in the transport direction from the nozzles and which abut against an upper surface of the sheet and press the sheet toward the platen, wherein: the holding members have abutment portions which are capable of abutting against the sheet respectively, at least parts of the respective abutment portions being positioned downwardly as compared with upper ends of the plurality of ribs; the plurality of ribs are provided to be positioned between the holding members in the width direction of the transport passage; the plurality of ribs include a first rib and a second rib which is provided at a position separated farther from a center of the transport passage as compared with the first rib in the widthwise direction of the transport passage; the plurality of holding members include a first holding member and a second holding member which is provided at a position separated farther from the center of the transport passage as compared with the first holding member in the widthwise direction of the transport passage; and at least one set of the plurality of ribs and the plurality of holding members are constructed in the transport direction so that an upstream end of the first rib is positioned on the upstream side as compared with an upstream end of the second rib or an abutment portion of the first holding member is positioned on the upstream side as compared with an abutment portion of the second holding member.

The sheet, which is transported along the transport passage, undergoes such a state in the vicinity of the platen that the sheet is interposed between the holding members and the platen. At least parts of the abutment portions of the holding members are positioned downwardly as compared with the upper ends of the ribs. When the sheet passes between the holding members and the platen, the sheet is pressed in the mutually opposite directions by both of the holding members and the ribs. Accordingly, the sheet is curved.

At least one set of the upstream ends of the plurality of ribs and the plurality of abutment portions, which are positioned at the more central position in the widthwise direction of the transport passage, are positioned on the more upstream side in the transport direction. In other words, during the process in which the sheet is transported, the sheet firstly undergoes such a state that the central portion in the widthwise direction of the transport passage is interposed between the holding members (abutment portions) and the platen, wherein the portions, which are disposed on the more outer sides, undergo such a state later that the portions are interposed between the holding members and the platen.

When the central portion of the sheet in the widthwise direction of the transport passage is curved, the portions of the sheet, which are disposed on the outer sides, are not interposed yet between the holding members and the platen. Therefore, the frictional force, which is received by the portions of the sheet disposed on the outer sides from the holding members and the platen, is small, and the sheet is easily pulled up to the center. In other words, the central portion of the sheet is easily curved. In this way, the central portion of the sheet can be sufficiently curved. Therefore, it is possible to decrease the dispersion of the amplitude of the wavy form (wavy shape) formed by the sheet.

According to the present invention, it is possible to decrease the dispersion of the amplitude of the wavy form formed by the sheet, and hence it is possible to perform the highly accurate image recording.

BRIEF DESCRIPTION OF THE DRAWINGS

FIGS. 5A to 5F show a holding member, wherein FIG. 5A shows a plan view, FIG. 5B shows a left side view, FIG. 5C shows a front view, FIG. 5D shows a right side view, FIG. 5E shows a perspective view, and FIG. 5F shows a bottom view.

FIG. 6A shows an embodiment of the present invention, and FIG. 6B shows a first embodiment of the present invention.

FIG. 8A shows a second modified embodiment of the present invention, and FIG. 8B shows a third modified embodiment of the present invention.

DESCRIPTION OF THE PREFERRED EMBODIMENTS

Figure 1:
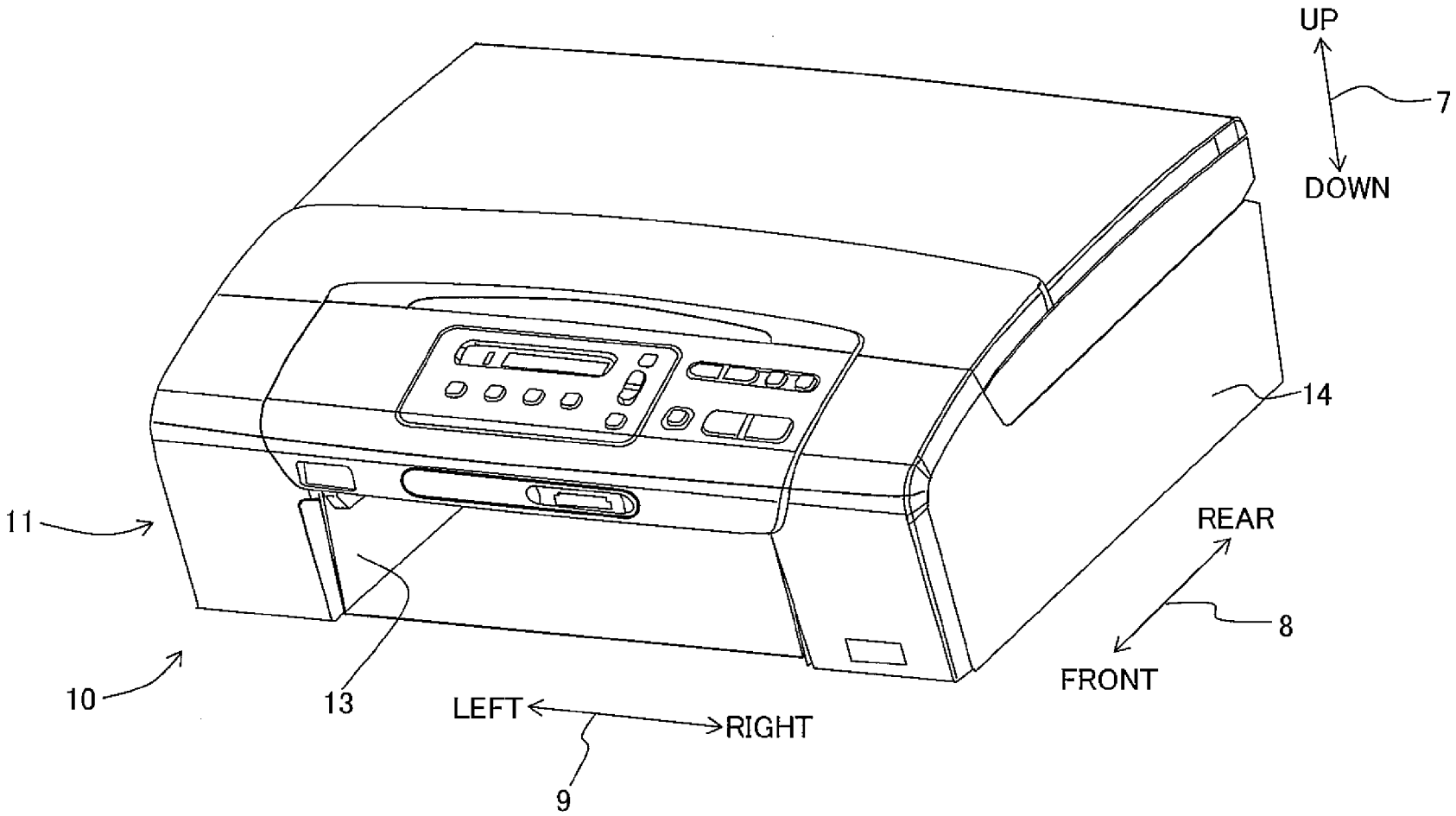
FIG. 1 shows a perspective view illustrating a multifunction machine according to an embodiment of the present invention.

An embodiment of the present invention will be explained below appropriately with reference to the drawings. The embodiment explained below is merely an example of the present invention. It goes without saying that the embodiment of the present invention can be appropriately changed or modified within a range without changing the gist or essential characteristics of the present invention. In the following description, the upward-downward direction 7 is defined on the basis of the state (state shown in FIG. 1) in which a multifunction machine 10 is installed usably. The front-rear direction 8 is defined assuming that the side, on which an opening 13 is provided, is the front side (front), and the left-right direction 9 (example of the widthwise direction of the present invention) is defined while the multifunction machine 10 is viewed from the front side (front).

As shown in FIG. 1, the multifunction machine 10 is generally formed to have a thin type rectangular parallelepiped form. A printer unit 11, which is based on the ink-jet recording system, is provided at a lower portion of the multifunction machine 10. The multifunction machine 10 has various functions including, for example, the facsimile function and the print function for recording an image on the recording paper 35 (example of the sheet of the present invention). The presence or absence of the function other than the print function is arbitrary. The printer unit 11 has a casing (housing) 14 which has the opening 13 formed on the front. A tray 20, on which the recording paper 35 having various sizes can be placed, can be inserted/withdrawn in the front-rear direction 8 through the opening 13. In other words, the tray 20 can be installed and removed with respect to the multifunction machine 10.

<Arrangement of Printer Unit 11>

Figure 2:
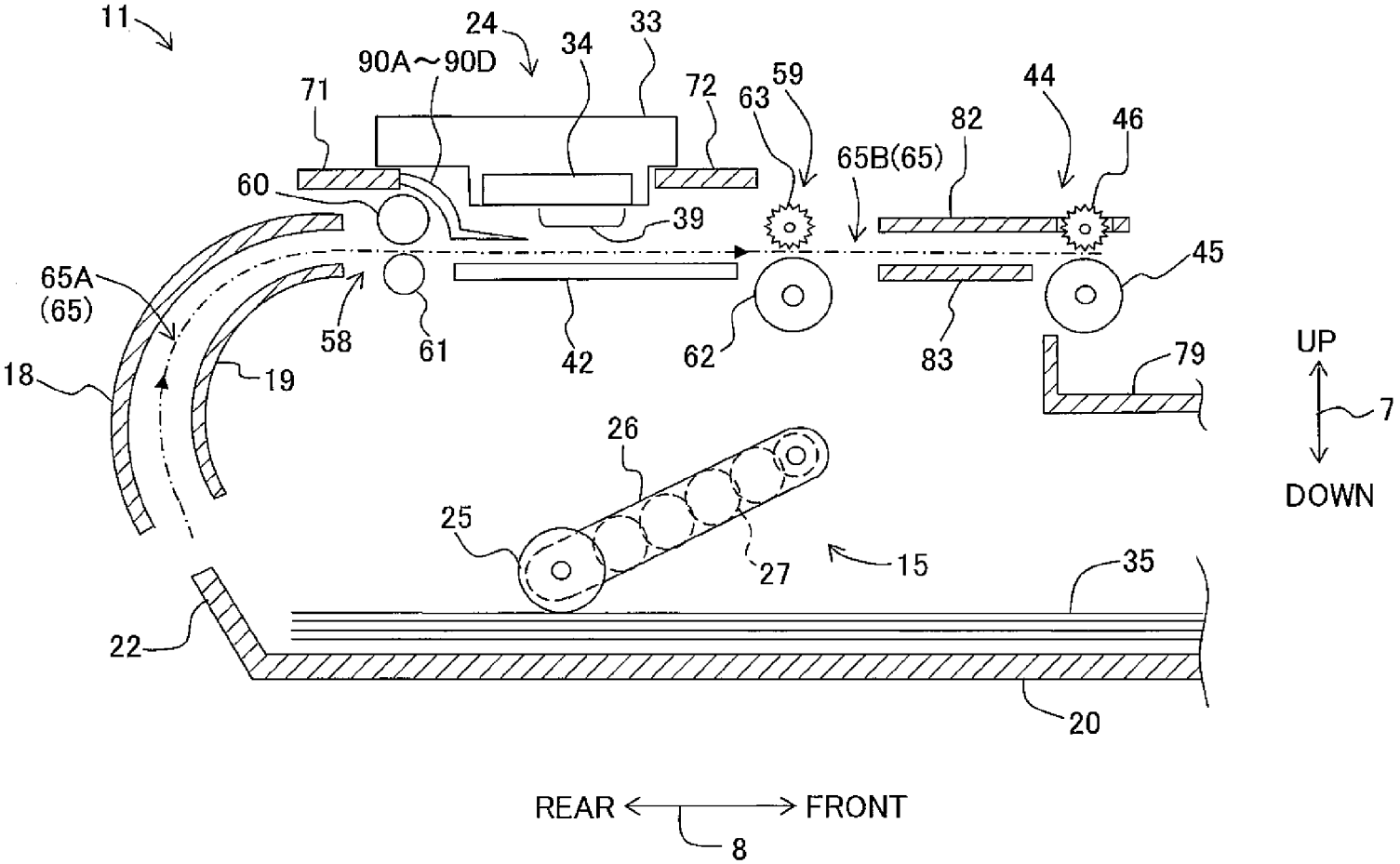
FIG. 2 schematically shows an arrangement of a printer unit.

As shown in FIG. 2, the printer unit 11 is provided with, for example, a paper feed unit 15 which picks up the recording paper 35 from the tray 20 and which feeds the recording paper 35, a recording section 24 (example of the recording section of the present invention) based on the ink-jet recording system which is provided over or above the tray 20 and which records the image on the recording paper 35 by discharging ink droplets onto the recording paper 35 fed by the paper feed unit 15.

<Paper Feed Unit 15>

As shown in FIG. 2, the paper feed unit 15 is provided under or below the recording section 24 over or above the tray 20. The paper feed unit 15 is provided with a paper feed roller 25, a paper feed arm 26, and a driving transmission mechanism 27. The paper feed roller 25 is rotated by transmitting the driving force of a paper feed motor (not shown) by means of the driving transmission mechanism 27 in which a plurality of gears are meshed with each other. The paper feed roller 25 supplies the recording paper 35 to a curved passage 65A as described later on.

<Transport Passage 65>

As shown in FIG. 2, a transport passage 65 (example of the transport passage of the present invention), which ranges from the forward end (end portion disposed on the back side) of the tray 20 via the recording section 24 to arrive at a discharged paper retaining unit 79, is formed in the printer unit 11. The transport passage 65 is divided into the curved passage 65A which is formed between the forward end of the tray 20 and the recording section 24, and a paper discharge passage 65B which is formed between the recording section 24 and the discharged paper retaining unit 79.

The curved passage 65A is the passage having a curved shape provided to extend from a portion disposed in the vicinity of the upper end of a separating inclined plate 22 provided for the tray 20 to the recording section 24. The curved passage 65A is generally formed to have a circular arc-shaped form having the center disposed on the inner side of the printer unit 11. The recording paper 35, which is fed from the tray 20, is guided to the position disposed just under the recording section 24 while being curved in the first transport direction (orientation of the arrow affixed to the alternate long and short dash line shown in FIG. 2, example of the transport direction of the present invention) in the transport direction (direction indicated by the alternate long and short dash line shown in FIG. 2) along the curved passage 65A. The curved passage 65A is comparted by an outer guide member 18 and an inner guide member 19 which are opposed to one another while being separated from each other by a predetermined spacing distance. Any one of the outer guide member 18, the inner guide member 19, and respective guide members 82, 83 described later on is allowed to extend in the direction perpendicular to the paper surface of FIG. 2 (left-right direction 9 shown in FIG. 1).

The paper discharge passage 65B is the linear or straight line-shaped passage provided to extend from the position disposed just under the recording section 24 to the discharged paper retaining unit 79. The recording paper 35 is guided in the first transport direction along the transport passage 65B. The paper discharge passage 65B is formed by the recording section 24 and a platen 42 (example of the platen of the present invention) which are opposed to one another while being separated from each other by a predetermined spacing distance at the portion at which the recording section 24 is provided. The paper discharge passage 65B is comparted by the upper guide member 82 and the lower guide member 83 which are opposed to one another while being separated from each other by a predetermined spacing distance at the portion at which the recording section 24 is not provided.

<Recording Section 24>

Figure 3:
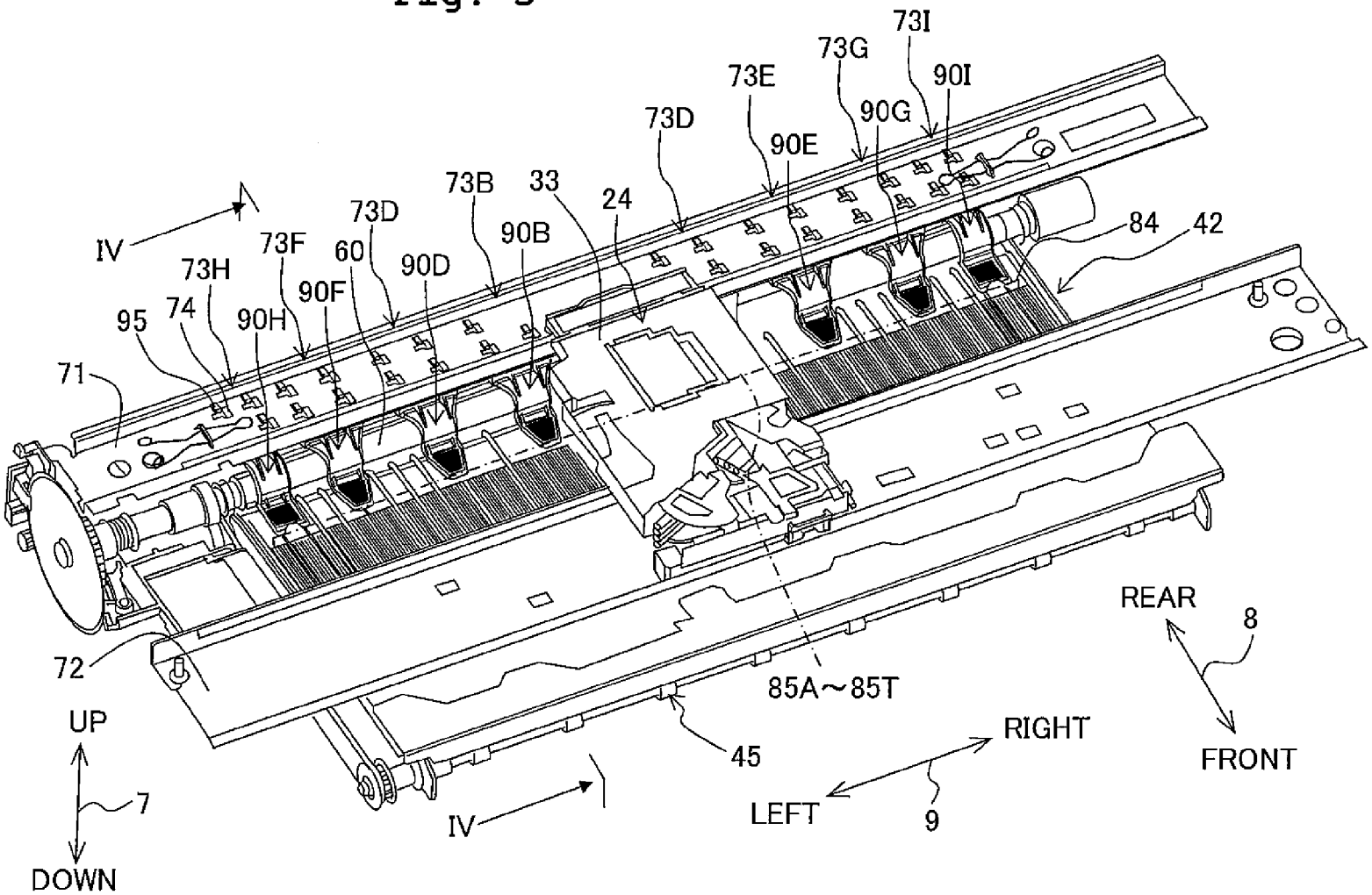
FIG. 3 shows a perspective view illustrating those disposed around a recording section.

As shown in FIGS. 2 and 3, the recording section 24 is arranged over or above the tray 20 (FIG. 2). The recording section 24 has a carriage 33, and a recording head 34 (FIG. 2) which is carried on the carriage 33. The carriage 33 is supported while spanning a first guide rail 71 and a second guide rail 72. The first guide rail 71 and the second guide rail 72 have substantially flat plate-shaped forms in which the left-right direction 9 is the longitudinal direction. The first guide rail 71 and the second guide rail 72 are provided while being separated from each other in the front-rear direction 8 at approximately the same height position in the upward-downward direction 7. The carriage 33 is reciprocatively movable in the left-right direction 9 together with the recording head 34 along the first guide rail 71 and the second guide rail 72.

The platen 42, which is provided to horizontally retain, i.e., support the recording paper 35, is provided at the position opposed to the recording section 24 while interposing the transport passage 65 under or below the recording section 24. The recording head 34 discharges inks supplied from ink cartridges (not shown) from a plurality of nozzles 39 (example of the nozzle of the present invention) provided between the first guide rail 71 and the second guide rail 72 to the recording paper 35 transported on the platen 42 during the process of the reciprocative movement in the left-right direction 9. Accordingly, the image is recorded on the recording paper 35 in the transport passage 65. Arrangements of the platen 42 and the first guide rail 71 will be described in detail later on.

<Transport Rollers 45, 60, 62>

As shown in FIG. 2, a first roller pair 58, which is composed of a first transport roller 60 and a pinch roller 61, is provided between the recording section 24 and the downstream ends in the first transport direction of the outer guide member 18 and the inner guide member 19. The pinch roller 61 is arranged under the first transport roller 60. The pinch roller 61 is brought in contact with the roller surface of the first transport roller 60 under pressure by an elastic member such as an unillustrated spring or the like. The recording paper 35, which is transported along the curved passage 65A, is interposed by the first roller pair 58, and the recording paper 35 is fed onto the platen 42.

A second roller pair 59, which is composed of a second transport roller 62 and a spur 63, is provided between the platen 42 and the upper guide member 82 and the lower guide member 83, i.e., on the downstream side in the first transport direction from the platen 42. The spur 63 is arranged over the second transport roller 62. The spur 63 is brought in contact with the roller surface of the second transport roller 62 under pressure by an elastic member such as an unillustrated spring or the like. The second roller pair 59 is arranged while allowing the nip position to be disposed closely to the platen 50. The recording paper 35, on which the image has been recorded by the recording section 24, is transported to the downstream side in the first transport direction while being interposed by the second transport roller 62 and the spur 63.

The rotational driving force is transmitted from a transport motor (not shown) via a driving transmission mechanism (not shown) to the respective transport rollers 60, 62, and thus the respective transport rollers 60, 62 are rotated. The driving transmission mechanism is composed of, for example, a planet gear. Even when the transport motor is rotated in any one of the positive rotating direction and the negative rotating direction, each of the transport rollers 60, 62 is rotated in one rotating direction. Accordingly, the recording paper 35 is transported in the transport direction.

A third roller pair 44, which is composed of a third transport roller 45 and a spur 46, is provided on the downstream side in the first transport direction from the second roller pair 59. The spur 46 is arranged over the third transport roller 45, and the spur 46 is brought in contact with the roller surface of the third transport roller 45 under pressure by an elastic member such as an unillustrated spring or the like.

The driving force is transmitted from the transport motor, and the third transport roller 45 is rotated. Accordingly, the recording paper 35 is transported to the downstream side in the transport direction by being interposed by the third transport roller 45 and the spur 46, and the recording paper 35 is discharged to the discharged paper retaining unit 79.

<Platen 42>

Figure 4:
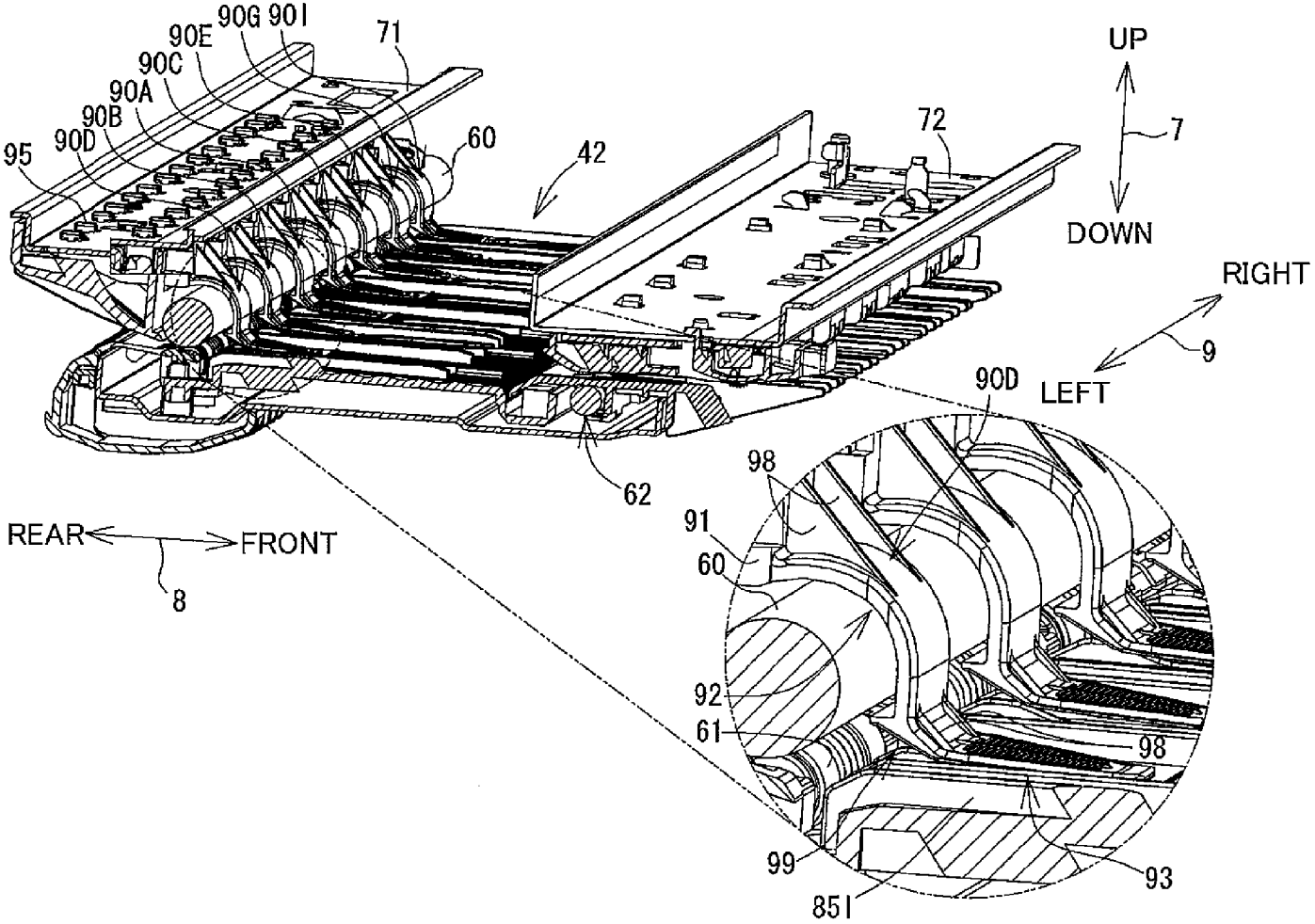
FIG. 4 shows a cross-sectional perspective view taken along a cutting plane line IV-IV shown in FIG. 3. It is noted that a recording section is omitted.
Figure 5A:
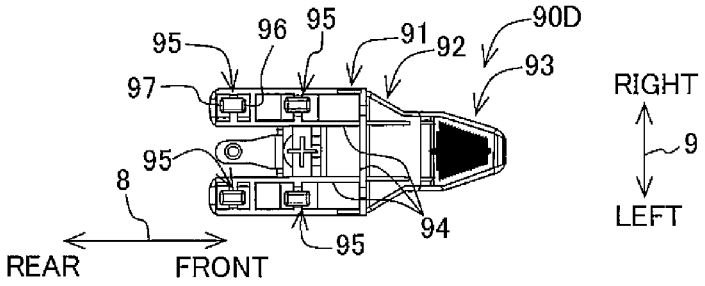
Figure 5B:
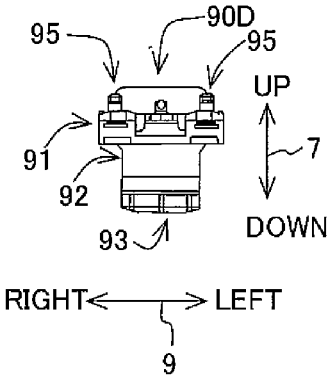
Figure 5C:
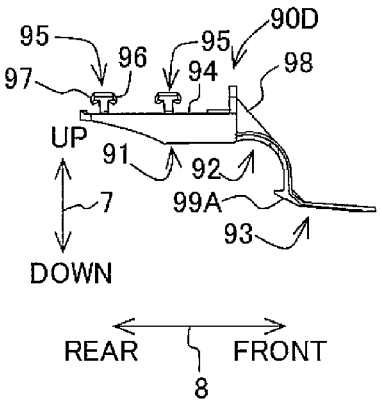
Figure 5D:
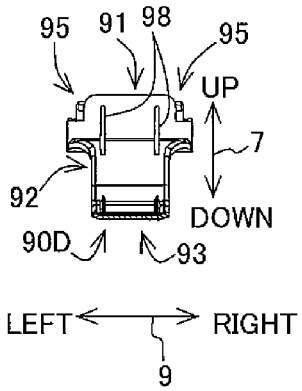
Figure 5E:
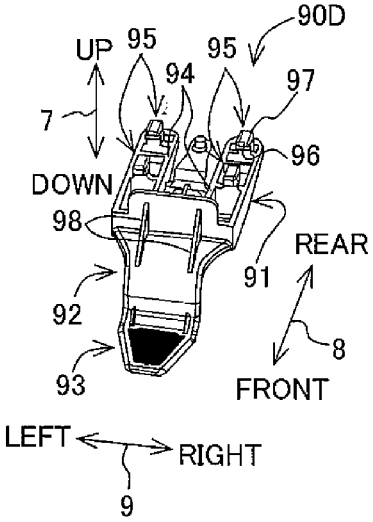
Figure 5F:
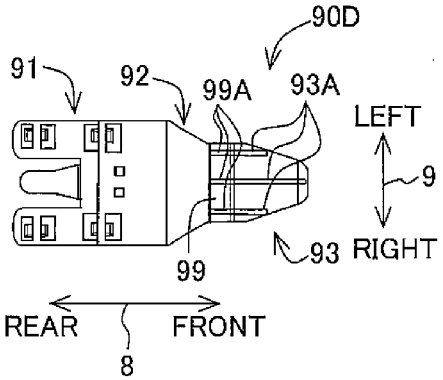

As shown in FIGS. 2 to 4, the platen 42 is provided on the just downstream side of the first roller pair 58 described above (on the front side in the front-rear direction 8). The platen 42 has a support surface 84 (FIG. 3) which is directed upwardly so that the support surface 84 is opposed to the recording section 24. The support surface 84 is exposed to the transport passage 65 (FIG. 2), and the support surface 84 comparts a part of the lower surface of the transport passage 65. A plurality of ribs 85A to 85T (FIGS. 3, 6A, and 7, example of the rib of the present invention) are allowed to protrude upwardly from the support surface 84. The ribs 85A to 85T have protruding shapes extending in parallel to one another in the front-rear direction 8 respectively.

Figure 6A:
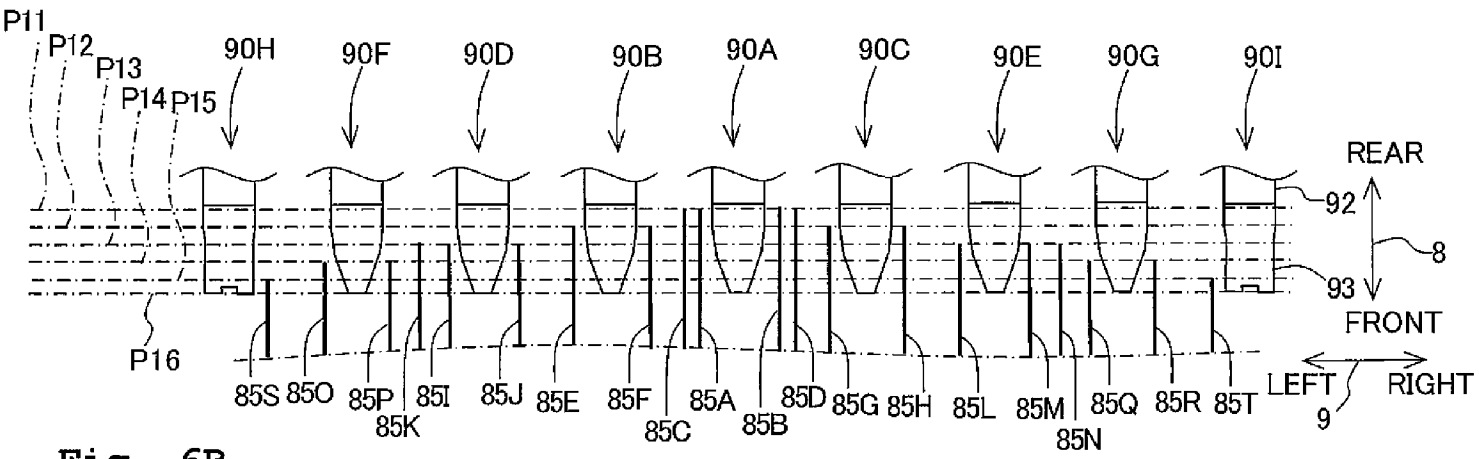
FIGS. 6A and 6B schematically shows the positional relationship in relation to holding members and ribs.

As shown in FIG. 6A, the distances between the adjoining rib 85A and the rib 85B, the rib 85E and the rib 85F, the rib 85G and the rib 85H, the rib 85I and the rib 85J, the rib 85L and the rib 85M, the rib 85O and the rib 85P, and the rib 85Q and the rib 85R in the left-right direction 9 are provided to be longer than the distances between the other ribs. Holding members 90A to 90G (FIGS. 3 to 5, example of the holding member of the present invention) are arranged therebetween respectively as described later on.

Although not shown in the drawings, the front ends (downstream ends in the first transport direction) of the ribs 85A to 85T are positioned frontwardly as compared with the nozzles 39 provided most frontwardly, which are disposed at the same position in the front-rear direction 8 in relation to all of the ribs 85A to 85T. On the other hand, as shown in FIG. 6A, the back ends (upstream ends in the first transport direction) of the ribs 85A to 85T are positioned at different positions P11 to P15. Details of the positions of the back ends of the ribs 85A to 85T will be described later on. In FIGS. 3 and 4, the arrangement, in which the back ends of the ribs 85A to 85T are positioned at the different positions, is omitted. The drawings are depicted as if the back ends of the ribs 85A to 85T are positioned at the same position.

<First Guide Rail 71>

As shown in FIG. 3, the first guide rail 71 is provided while providing a predetermined spacing distance over the transport roller 60 in the vicinity of the back end of the platen 42 in the front-rear direction 8. The first guide rail 71 has a generally rectangular flat plate-shaped form having the long side disposed in the left-right direction 9. The first guide rail 71 is provided so that the front and back surfaces are substantially parallel to the support surface 84 of the platen 42 respectively. The first guide rail 71 traverses the transport passage 65 in the left-right direction 9, and the first guide rail 71 is supported at the both end portions. The first guide rail 71 has a plurality of attachment sections 73A to 73I for attaching the holding members 90A to 90I respectively in the left-right direction 9. Each of the attachment sections 73A to 731 is composed of four insertion holes 74 which penetrate through the front and back surfaces of the first guide rail 71 in the upward-downward direction 7. Insertion projections 95 (FIGS. 3 to 5) of the holding members 90A to 90I are inserted into the respective insertion holes 74, and thus the holding members 90A to 90I are attached to the first guide rail 71.

<Holding Members 90A to 90I>

The holding members 90A to 90I are the members which cooperate with the ribs 85A to 85T of the platen 42 so that the recording paper 35, which is to be transported, is allowed to have the wavy form (wavy shape). As shown in FIGS. 4 and 6A, one holding member 90A is arranged at the center of the platen 42 in the left-right direction 9 (one holding member is hidden by the carriage 33 in FIG. 3). The holding members 90B to 90I are arranged while being separated by predetermined distances on the both outer sides in the left-right direction 9 of the holding member 90A. The holding member 90B and the holding member 90C, the holding member 90D and the holding member 90E, the holding member 90F and the holding member 90G, and the holding member 90H and the holding member 90I are arranged respectively at symmetrical positions with respect to the holding member 90A, for the following reason. That is, it is intended to allow the recording paper 35 to have a bilaterally symmetrical wavy form.

As shown in FIG. 6, in the left-right direction 9, the holding member 90A is arranged between the rib 85A and rib 85B, the holding member 90B is arranged between the rib 85E and rib 85F, the holding member 90C is arranged between the rib 85G and rib 85H, the holding member 90D is arranged between the rib 85I and rib 85J, the holding member 90E is arranged between the rib 85L and rib 85M, the holding member 90F is arranged between the rib 85O and rib 85P, and the holding member 90G is arranged between the rib 85Q and rib 85R. Further, the holding member 90H is arranged on the left side of the rib 85S, and the holding member 90I is arranged on the right side of the rib 85T.

The holding members 90A to 90I will be explained below with reference to the respective drawings. In the following description, the holding member 90D is exemplified by way of example. However, the holding members 90A to 90G are constructed in the same manner. The holding members 90H, 90I have the shapes which are partially different from those of the holding members 90A to 90G. This difference will be described later on. The upward-downward direction 7, the front-rear direction 8, and the left-right direction 9 shown in FIGS. 5A, 5B, 5D, 5E and 5F are provided as the directions as brought about in the state in which the holding members 90A to 90I are attached to the guide rails 71.

As shown in FIGS. 4 and 5, the holding member 90D is a resin molded product comprising a plate-shaped base portion 91, a curved tab 92 which extends downwardly while being curved from a front surface of the base portion 91 in the front-rear direction 8, and a holding tab 93 (example of the abutment portion of the present invention) which extends obliquely downwardly in the frontward direction while being slightly inclined with respect to the horizontal surface from a lower end of the curved tab 92. A plurality of reinforcing ribs 94 for effecting the reinforcement (FIG. 5) and four insertion projections 95 (FIGS. 3 to 5) to be inserted into the insertion holes 74 (FIG. 3) of the first guide rail 71 are allowed to protrude upwardly from the upper surface of the base portion 91. The four insertion projections 95 are arranged at positions at which the insertion projections 95 are aligned two by two in the front-rear direction 8 and the left-right direction 9.

A pair of front and back pawls 96, 97 (FIG. 5), which are engageable with the upper surface of the first guide rail 71, are provided at the forward end portion (upper end portion) of the protrusion of the insertion projection 95. The pawl 96 protrudes frontwardly in the front-rear direction 8 from the forward end portion (upper end portion) of the protrusion of the insertion projection 95. The pawl 97 protrudes backwardly in the front-rear direction 8 from the forward end portion (upper end portion) of the protrusion of the insertion projection 95. When the holding member 90D is attached, then the insertion projection 95 is inserted into the insertion hole 74 from the lower side of the first guide rail 71, and then the insertion projection 95 is allowed to slide leftwardly in the left-right direction 9. The inner diameter of the left portion of the insertion hole 74 is smaller than that of the right portion.

Therefore, a state is given, in which the pawls 96, 97 are fitted into the insertion hole 74. Thus, the holding member 90D is fixed to the first guide rail 71.

The curved tab 92 is curved in a circular arc-shaped form, for the following reason. That is, it is intended to avoid the contact of the curved tab 92 with the first transport roller 60. The curved tab 92 is reinforced by reinforcing ribs 98 so that the curved tab 92 is not flexibly bent.

An inclined surface 99, which is inclined obliquely downwardly in the frontward direction from the front side in the front-rear direction 8 of the nip position of the first roller pair 58, is provided at the lower end portion of the curved tab 92. A plurality of guide ribs 99A (FIG. 5) are provided on the inclined surface 99 to extend in the direction (obliquely downwardly in the frontward direction) in which the inclined surface 99 is inclined. The plurality of guide ribs 99A are arranged while being separated from each other in the left-right direction 9. The downstream end of the recording paper 35 in the first transport direction is guided to the holding tab 93 by the forward ends of the protrusion of the guide ribs 99A.

A part of the holding tab 93 is positioned below the upper end of each of the ribs 85A to 85T. The holding tab 93 is formed to have the plate-shaped form which is slightly inclined with respect to the horizontal surface so that the front end in the front-rear direction 8 is positioned downwardly as compared with the back end. The front end (downstream end in the first transport direction) of the holding tab 93 in the front-rear direction 8 is positioned at the back of the nozzles 39 of the recording head 34 in the front-rear direction 8, and the front end of the holding tab 93 is disposed closely to the nozzles 39.

Figure 7:
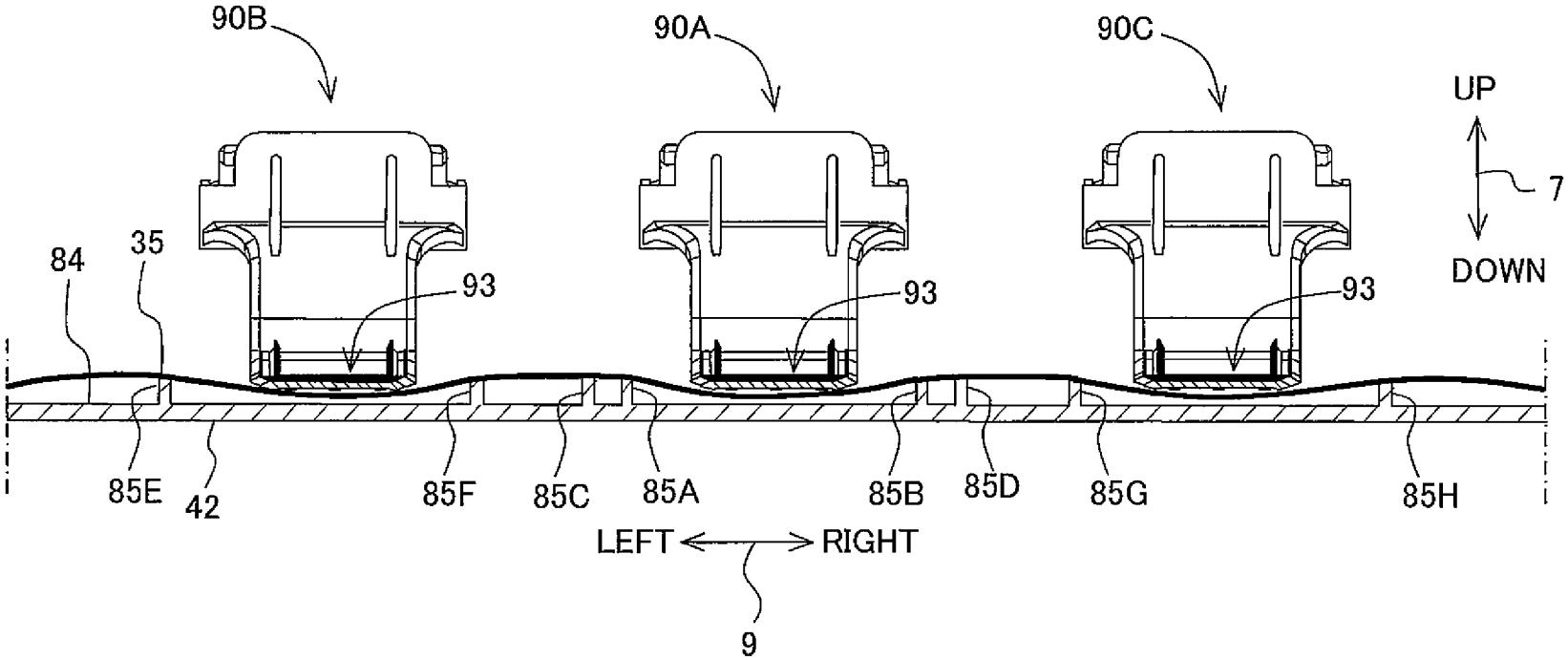
FIG. 7 shows a situation in which the recording paper is allowed to have a wavy form by means of the holding members and the ribs.

The reason, why the part of the holding tab 93 is positioned below the upper end of each of the ribs 85A to 85T, is that the recording paper 35 is pressed in the opposite orientations in the upward-downward direction to provided the wavy form. The reason, why the holding tab 93 is inclined, is that it is intended not to jam the transported recording paper 35 between the holding tab 93 and the support surface 84 of the platen 42 (FIGS. 3, 7). The reason, why the holding tab 93 is plate-shaped, is that it is intended to arrange the holding tab 93 in the small gap between the recording head 34 and the support surface 84 of the platen 42. The reason, why the front end of the holding tab 93 in the front-rear direction 8 is disposed closely to the nozzles 39, is that it is intended to improve the accuracy of the image recording by holding the recording paper 35 at the position disposed closely to the nozzles 39. In this embodiment, the lower surface of the holding tab 94 for holding the recording paper 35 is an example of the abutment surface of the present invention.

The holding tab 93 is allowed to have a tapered shape in which the both ends in the left-right direction 9 are inclined to approach to one another at positions disposed more frontwardly in the front-rear direction so that the holding tab 93 is elastically deformed with ease in the upward-downward direction 7. The front end portion of the holding tab 93 is flexibly bent when the transported recording paper 35 is allowed to have the wavy shape. The holding tab 93 is also flexibly bent when the recording paper 35 having a slightly thick thickness is transported or when a plurality of sheets of the recording paper 35 are fed in a superimposed manner. Thus, the recording paper 35 is suppressed from being jammed between the holding tab 93 and the platen 42. Further, as shown in FIG. 6A, the front ends of the holding tabs 93 of the holding members 90A to 90I are positioned at the mutually identical positions in the front-rear direction 8.

As shown in FIGS. 3 and 6A, as for the holding members 90H, 90I, the portion for holding the recording paper 35 has the shape which is different from the shape of each of the holding members 90A to 90G. In particular, in the case of the holding members 90H, 90I, the portion, which corresponds to the holding tab 93 of each of the holding members 90A to 90G, does not have the tapered shape, and the portion has a generally rectangular shape. The holding members 90H, 90I are provided to hold the both left and right ends of the recording paper 35 on the both outer sides in the left-right direction 9. Therefore, the wide width shape is adopted for the holding tab 93 in order to prevent the end portion of the recording paper 35 from being deviated inwardly in the left-right direction 9 during the transport.

<Positional Relationship of Ribs 85A to 85T>

As described above, the back ends of the ribs 85A to 85T are positioned at the different positions P11 to P15 in the front-rear direction 8 respectively. An explanation will be made in detail below with reference to FIG. 6A.

In the left-right direction 9, the ribs 85A, 85B disposed on the both outer sides of the holding member 90A and the ribs 85C, 85D disposed on the both further outer sides have their back ends which are positioned at the position P11. The position P11 is disposed slightly frontwardly as compared with the back ends of the respective holding members 90A to 90I.

In the left-right direction 9, the ribs 85E, 85F disposed on the both outer sides of the holding member 90B and the ribs 85G, 85H disposed on the both outer sides of the holding member 90C have their back ends which are positioned at the position P12. The position P12 is disposed more frontwardly by a predetermined distance as compared with the position P11.

In the left-right direction 9, the ribs 85I, 85J disposed on the both outer sides of the holding member 90D and the rib 85K disposed on the further left side thereof, as well as the ribs 85L, 85M disposed on the both outer sides of the holding member 90E and the rib 85N disposed on the further right side thereof have their back ends which are disposed at the position P13. The position P13 is disposed more frontwardly by a predetermined distance as compared with the position P12.

In the left-right direction 9, the ribs 85O, 85P disposed on the both outer sides of the holding member 90F and the ribs 85Q, 85R disposed on the both outer sides of the holding member 90G have their back ends which are positioned at the position P14. The position P14 is disposed more frontwardly by a predetermined distance as compared with the position P13.

In the left-right direction 9, the rib 85S disposed on the inner side of the holding member 90H and the rib 85T disposed on the inner side of the holding member 90I have their back ends which are positioned at the position P15. The position P15 is disposed more frontwardly by a predetermined distance as compared with the position P14, and the position P15 is disposed more backwardly as compared with the position P16 of the front end of each of the holding tabs 93.

According to the foregoing description, as for the back ends of the ribs 85A to 85T, those disposed on the inner side in the left-right direction 9 are positioned more backwardly in the front-rear direction 8. The distance between the positions P11 to P14 can be arbitrarily determined by those skilled in the art. For example, the distance between the adjoining positions P11 to P14 is 5 mm. The holding tabs 93 of all of the holding members 90A to 90I and all of the ribs 85A to 85T are partially overlapped in the width direction of the transport passage 65 (left-right direction 9 in FIG. 6A) at predetermined position (between the positions P15 and P16 in FIG. 6A) in a transport direction of the recording paper 35 (front-rear direction 8 in FIG. 6A).

<Transport of Recording Paper 35>

The recording paper 35 is transported along the transport passage 65, and the recording paper 35 is supplied to the recording section 24. During the process in which the recording paper 35 is transported along the transport passage 65, the recording paper 35 is in a state of being interposed between the first roller pair 58. After the recording paper 35 is interposed between the first roller pair 58, the downstream end (front end in the front-rear direction 8) of the recording paper 35 is fed onto the platen 42. When the downstream end of the recording paper 35 arrives at the back ends of the ribs 85A to 85T of the platen 42, then the recording paper 35 is in a state of being interposed by the ribs 85A to 85T of the platen 42 and the holding tabs 93 of the holding members 90A to 90I, and the recording paper 35 is curved in the wavy form in the left-right direction 9 as shown in FIG. 7.

The upstream side of the recording paper 35 is still in the state of being interposed by the ribs 85A to 85T and the holding tabs 93 of the holding members 90A to 90I after the downstream end of the recording paper 35 passes through the respective holding tabs 93. Therefore, the wavy form of the recording paper 35 is maintained around the platen 42. The recording paper 35 is transported on the platen 42 in this state.

When a part of the recording paper 35 passes under the recording head 34, the image is recorded thereon. The downstream end of the recording paper 35 is in a state of being interposed by the second roller pair 59 after the downstream end of the recording paper 35 passes under the recording head 34. In other words, the recording paper 35 is interposed by the first roller pair 58 on the upstream side from the recording head 34, and the recording paper 35 is interposed by the second roller pair 59 on the downstream side from the recording head 34. The recording paper 35 is transported by the transporting forces of the rollers.

Subsequently, when the upstream end of the recording paper 35 passes through the first roller pair 58, the recording paper 35 is in a state of being interposed by only the second roller pair 59. The upstream end of the recording paper 35 passes under the holding members 90A to 90I respectively by the transporting force of the second transport roller 62, and the recording paper 35 is released from the wavy form. When all portions of the recording paper 35 pass under the recording head 34, the recording of the image is completed. The recording paper 35, which has passed through the platen 42, is transported toward the third roller pair 44.

In this case, the back ends of the ribs 85A to 85T are in the positional relationship as described above respectively. Therefore, when the downstream end of the recording paper 35 is in the state of being interposed by the ribs 85A to 85T and the holding tabs 93 of the holding members 90A to 90I, then the portion of the recording paper 35 disposed at the central position in the left-right direction 9 is curved earlier, and the portions disposed on the outer sides are curved later. An explanation will be made in detail below with reference to FIG. 6A.

When the downstream end of the recording paper 35 arrives at the position P11, then the recording paper 35 is interposed by the holding tab 93 of the holding member 90A and the ribs 85A to 85D, and the recording paper 35 is pressed in the different orientations in the upward-downward direction. Accordingly, the portion of the recording paper 35, which is disposed in the vicinity of the holding member 90A, is curved.

When the downstream end of the recording paper 35 arrives at the position P12, then the recording paper 35 is interposed by the holding tab 93 of the holding member 90B and the ribs 85E to 85F, and the recording paper 35 is pressed in the different orientations in the upward-downward direction. Further, the recording paper 35 is interposed by the holding tab 93 of the holding member 90C and the ribs 85G to 85H, and the recording paper 35 is pressed in the different orientations in the upward-downward direction. Accordingly, the portions of the recording paper 35, which are disposed in the vicinity of the holding members 90B, 90C, are curved.

When the downstream end of the recording paper 35 arrives at the position P13, then the recording paper 35 is interposed by the holding tab 93 of the holding member 90D and the ribs 85I to 85K, and the recording paper 35 is pressed in the different orientations in the upward-downward direction. Further, the recording paper 35 is interposed by the holding tab 93 of the holding member 90E and the ribs 85L to 85N, and the recording paper 35 is pressed in the different orientations in the upward-downward direction. Accordingly, the portions of the recording paper 35, which are disposed in the vicinity of the holding members 90D, 90E, are curved.

When the downstream end of the recording paper 35 arrives at the position P14, then the recording paper 35 is interposed by the holding tab 93 of the holding member 90F and the ribs 85O to 85P, and the recording paper 35 is pressed in the different orientations in the upward-downward direction. Further, the recording paper 35 is interposed by the holding tab 93 of the holding member 90G and the ribs 85Q to 85R, and the recording paper 35 is pressed in the different orientations in the upward-downward direction. Accordingly, the portions of the recording paper 35, which are disposed in the vicinity of the holding members 90F, 90G, are curved.

When the downstream end of the recording paper 35 arrives at the position P15, then the recording paper 35 is interposed by the holding tab 93 of the holding member 90H and the rib 85S, and the recording paper 35 is pressed in the different orientations in the upward-downward direction. Further, the recording paper 35 is interposed by the holding tab 93 of the holding member 90I and the rib 85T, and the recording paper 35 is pressed in the different orientations in the upward-downward direction. Accordingly, the portions of the recording paper 35, which are disposed in the vicinity of the holding members 90H, 90I, are curved.

In accordance with the flow as described above, the recording paper 35 is curved to provide the wavy form in the left-right direction 9. The recording paper 35 is released from the wavy form when the upstream end of the recording paper 35 passes through the front end of each of the holding tabs 93. The front ends of the holding tabs 93 are positioned at the same position P16 in the front-rear direction 8 in relation to all of the holding members 90A to 90I. Therefore, the recording paper 35 is released from the wavy form substantially simultaneously in relation to those in the left-right direction 9.

<Function and Effect of Embodiment>

In the case of any conventional arrangement in which the back ends of the ribs 85A to 85T are aligned in one array in the left-right direction 9, the recording paper 35 is curved approximately simultaneously over the entire range in the left-right direction 9 to provide the wavy form. In this case, a large force is required to pull the recording paper 35 up to the central position on account of the frictional force received by the recording paper 35 from the respective holding tabs 93 and the ribs 85A to 85T. Therefore, the portions of the recording paper 35, which are disposed at the more central positions, are hardly curved, and any dispersion arises in the amplitude of the wavy form formed by the sheet.

According to this embodiment, the back ends of the ribs 85A to 85T, which are disposed at the more central positions in the left-right direction 9, are positioned more backwardly in the front-rear direction 8. Therefore, when the portions of the recording paper 35, which are disposed at the central positions in the left-right direction 9, are curved, the portions of the recording paper 35, which are disposed on the outer sides, are not interposed between the holding tabs 93 and the ribs 85A to 85T yet. Therefore, the portions of the recording paper 35, which are disposed on the outer sides, receive the small frictional force, and the recording paper 35 is easily pulled up to the center. In other words, the portion of the recording paper 35, which is disposed at the central position, is easily curved. In this way, the portion of the recording paper 35, which is disposed at the central position, can be sufficiently curved. Therefore, it is possible to decrease the dispersion of the amplitude of the wavy form formed by the recording paper 35.

The recording paper 35 is in the state of being interposed by all of the holding tabs 93 and the ribs 85A to 85T in the range ranging from the back ends (position P15) of the ribs 85S, 85T to the front ends (position 16) of the respective holding tabs 93 in the front-rear direction 8. Therefore, the recording paper 35 can be curved efficiently. Further, it is possible to prevent the recording paper 35 from being released from the wavy form.

The recording paper 35 is pressed by the lower surfaces of the holding tabs 93, and thus it is possible to provide, in the transport direction, the range in which the holding tabs 93 abut against the recording paper 35. Therefore, the recording paper 35 can be allowed to be in the curved state efficiently. Further, it is possible to prevent the recording paper 35 from being released from the wavy form.

[First Modified Embodiment]

Figure 6B:
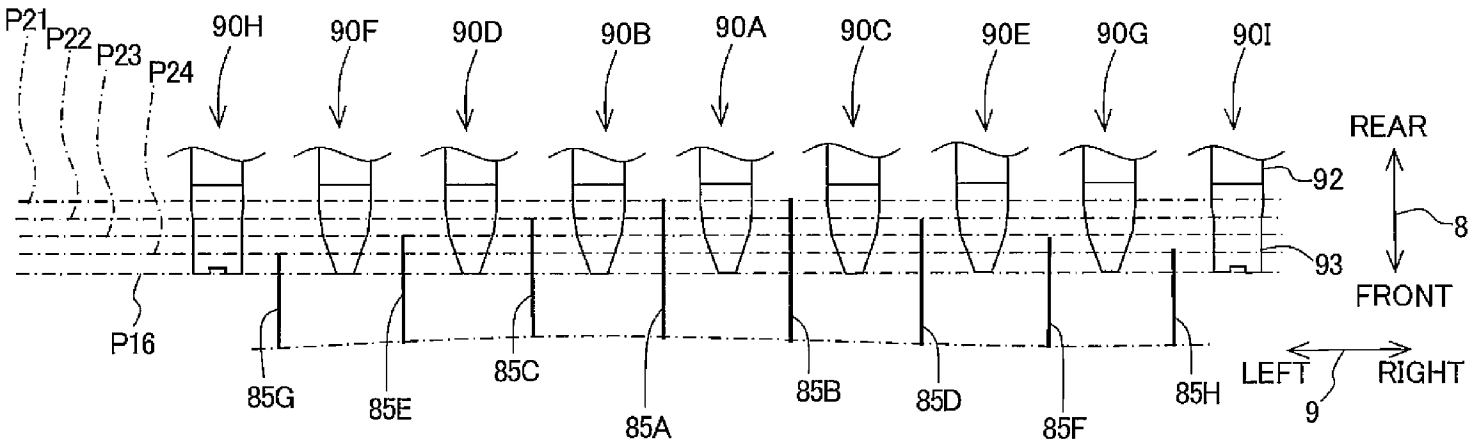

In the embodiment described above, two or more ribs 85A to 85T are provided between the respective holding members 90A to 90I in the left-right direction 9. However, as shown in FIG. 6B, the ribs 85A to 85H may be provided one by one between the respective holding members 90A to 90I.

In the front-rear direction 8, the back ends of the ribs 85A, 85B are positioned at the position P21, the back ends of the ribs 85C, 85D are positioned at the position P22, the back ends of the ribs 85E, 85F are positioned at the position P23, and the back ends of the ribs 85G, 85H are positioned at the position P24.

The downstream end of the recording paper 35 successively passes through the position P21, the position P22, the position P23, and the position P24 in this order. When the downstream end of the recording paper 35 passes through the positions P21 to P24 respectively, the recording paper 35 is curved by being interposed by each of the corresponding ribs 85A to 85H and the holding tabs 93 disposed on the both outer sides of each of the concerning ribs 85A to 85H. In other words, also in this embodiment, the portions of the recording paper 35, which are disposed at the more central positions, are curved earlier.

[Second Modified Embodiment]

Figure 8A:
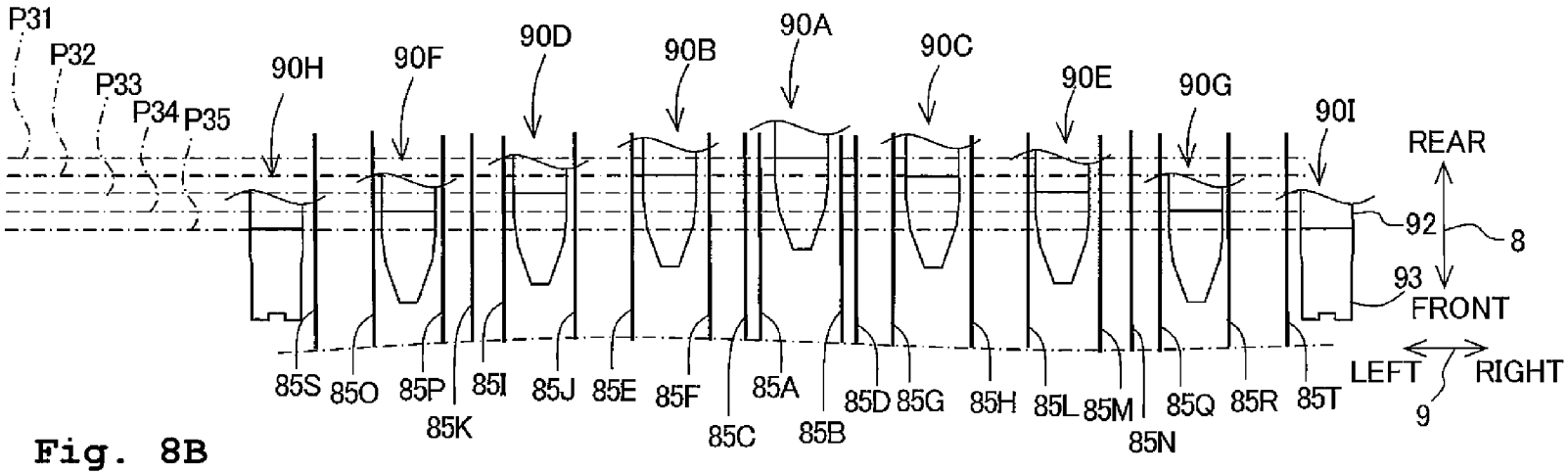
FIGS. 8A and 8B schematically shows the positional relationship in relation to holding members and ribs.

In the embodiment described above, the positions of the back ends of the ribs 85A to 85T in the front-rear direction 8 are different from each other. However, the back ends of the ribs 85A to 85T may be disposed at mutually identical positions. In this case, as shown in FIG. 8A, the holding members 90A to 90I are arranged at different positions in place of the back ends of the ribs 85A to 85T.

In the front-rear direction 8, the back end of the holding tab 93 of the holding member 90A is positioned at the position P31, the back ends of the holding tabs 93 of the holding members 90B, 90C are positioned at the position P33, the back ends of the holding tabs 93 of the holding members 90D, 90E are positioned at the position P33, the back ends of the holding tabs 93 of the holding members 90F, 90G are positioned at the position P34, and the back ends of the holding tabs 93 of the holding members 90H, 90I are positioned at the position P35. In other words, the holding members 90A to 90I, which are disposed at the more central positions, are arranged more backwardly. The back ends of the ribs 85A to 85T in the front-rear direction 8 are positioned more backwardly as compared with the position P31.

The downstream end of the recording paper 35 successively passes through the position P31, the position P32, the position P33, the position P34, and the position P35 in this order. When the downstream end of the recording paper 35 passes through the positions P31 to P35 respectively, the recording paper 35 is curved by being interposed by the holding tab 93 of each of the corresponding holding members 90A to 90I and the ribs 85A to 85T disposed on the both outer sides of each of the concerning holding members 90A to 90I. In other words, also in this modified embodiment, the portions of the recording paper 35, which are disposed at the more central positions, are curved earlier.

Although not shown in the drawings, the insertion holes 74 of the first guide rail 71 are provided at mutually different positions in order to arrange the holding members 90A to 90I at the mutually different positions. According to this arrangement, the resin molded products, which have the same shapes, can be used for the holding members 90A to 90G and the holding members 90H, 90I respectively. Therefore, it is possible to reduce the production cost.

[Third Modified Embodiment]

Figure 8B:
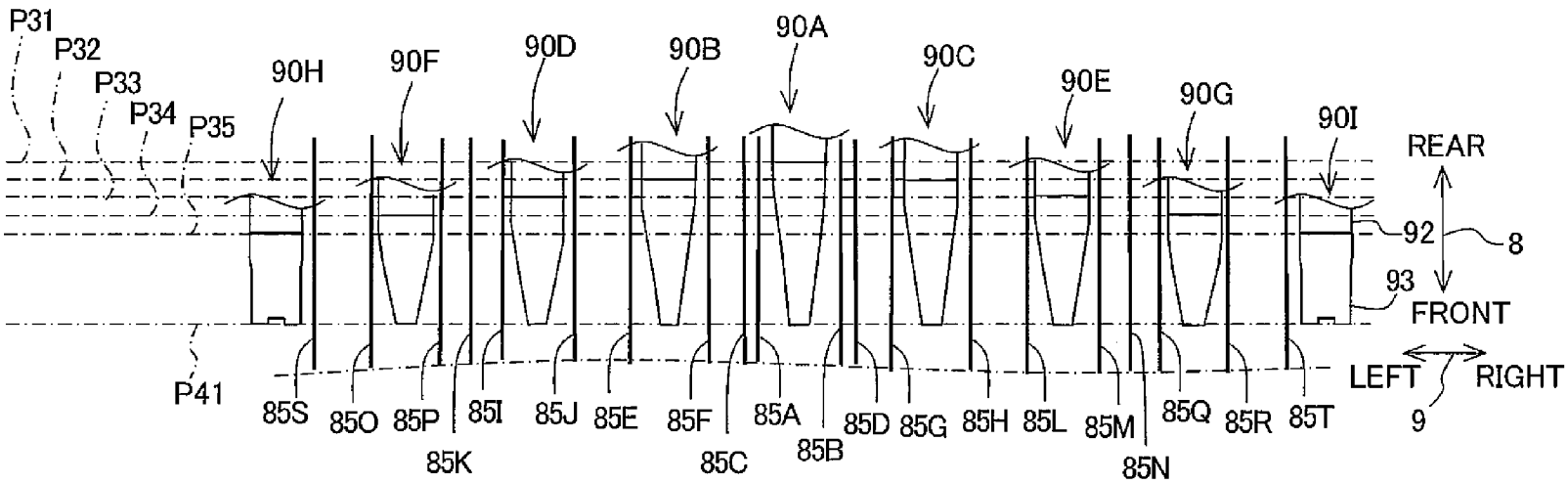

As shown in FIG. 8B, in the second modified embodiment described above, the front ends of the holding tabs 93 of all of the holding members 90A to 90I may be positioned at the same position P41 in the front-rear direction 8. In other words, the size or dimension of the holding tab 93 is made longer in the front-rear direction 8 for the holding members 90A to 90I disposed at the more central positions in the left-right direction 9.

Also in this arrangement, the portions of the recording paper 35, which are disposed at the more central positions, are curved earlier to provide the wavy form. Further, the upstream end of the recording paper 35 passes through the front ends of the holding tabs 93 at the position P41. In this situation, the pressing actions, which are exerted on the recording paper from the upward positions by the holding tabs 93, are eliminated approximately simultaneously at all of the positions in the left-right direction 9. In other words, the recording paper is completely released from the wavy form. Accordingly, it is possible to avoid the decrease in the accuracy of the image recording which would be otherwise caused by partially releasing the recording paper from the wavy form.

[Fourth Modified Embodiment]

Figure 9:
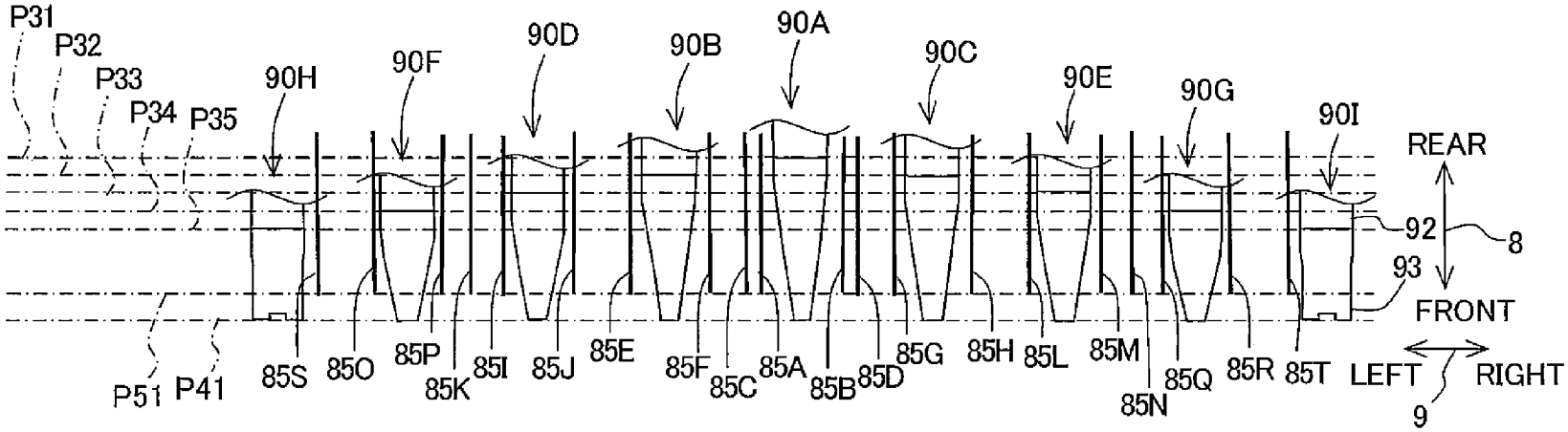
FIG. 9 schematically shows the positional relationship in relation to holding members and ribs, illustrating a fourth modified embodiment of the present invention.

As shown in FIG. 9, in the third embodiment described above, the front ends of the ribs 85A to 85T may be positioned at the position P51 disposed more backwardly from the position P41. In other words, the front ends of the ribs 85A to 85T may be positioned backwardly from the front ends of the holding tabs 93.

Also in this arrangement, the portions of the recording paper 35, which are disposed at the more central positions, are curved earlier to provide the wavy form. Further, at the position P51, the upstream end of the recording paper 35 passes through the front ends of the ribs 85A to 85T. In this situation, the pressing actions, which are exerted on the recording paper from the downward positions by the ribs 85A to 85T, are eliminated approximately simultaneously at all of the positions in the left-right direction 9. In other words, the recording paper is completely released from the wavy form. Accordingly, it is possible to avoid the decrease in the accuracy of the image recording which would be otherwise caused by partially releasing the recording paper from the wavy form.

In FIG. 9, the front ends of all of the holding tabs 93 are positioned at the position P41 in the same manner as in the third modified embodiment. However, the front ends of the holding tabs 93 may be positioned at different positions in the front-rear direction 8 provided that the front ends of the holding tabs 93 are disposed frontwardly as compared with the position P51.

[Other Modified Embodiments]

Figure 10:
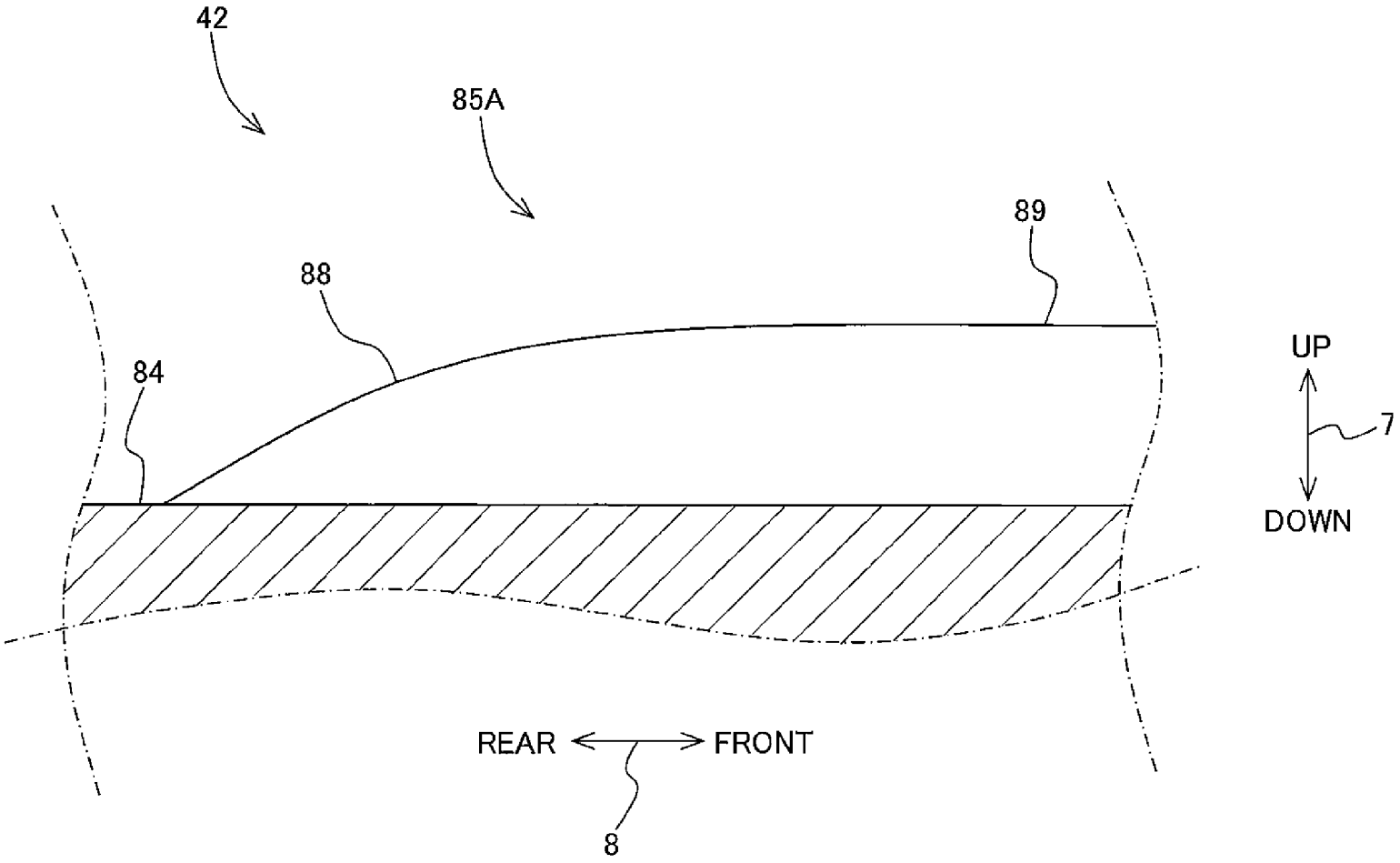
FIG. 10 shows those disposed around a back end of a rib according to another modified embodiment of the present invention.

As shown in FIG. 10, each of the ribs 85A to 85T may have an inclined portion 88 extending frontwardly from the back end in the front-rear direction 8. FIG. 10 is illustrative of the rib 85A by way of example. However, the same structure is provided for all of the ribs 85A to 85T. The inclined portions 88 are the portions which are inclined so that the upper ends are positioned more upwardly at more frontward positions. A straight line portion 89, which has the upper end extending in parallel to the support surface 84 of the platen 42, is continued on the front side from the inclined portion 88.

When the downstream end of the recording paper 35 transported in the first transport direction arrives at the back ends of the ribs 85A to 85T, the recording paper 35 is transported along the inclined portions 88 to provide such a state that the recording paper 35 rides on the ribs 85A to 85T. After that, the recording paper 35 is transported on the platen 42 while making the sliding movement on the upper ends of the straight line portions 89 of the ribs 85A to 85T. According to this arrangement, it is possible to avoid the stop of the transport of the recording paper 35 which would be otherwise caused such that the downstream end of the recording paper 35 abuts against the back ends of the ribs 85A to 85T.

In the embodiment described above, the holding tabs 93 of the holding members 90A to 90I may be elastically urged toward the support surface 84 of the platen by means of the curved tabs 92. In this case, the holding member 90A may have the largest urging force. When the portion of the recording paper 35, which is disposed at the central position, is curved earlier, the force, which is larger than the force required to curve the portion disposed on the outer side, is required in order to curve the portion disposed at the central position of the recording paper 35. According to this arrangement, the recording paper 35 is pressed strongly at the central position, and hence the portion of the recording paper 35, which is disposed at the central position, can be sufficiently curved.

In the embodiment described above, the nine holding members 90A to 90I and the twenty ribs 85A to 85T are provided. However, the numbers of holding members and the ribs are appropriately changed depending on the width of the transport passage 65 in the left-right direction 9 and the size or dimension of the recording paper 35 to be transported.

In the embodiment described above, the holding members 90A to 90I are attached to the first guide rail 71 respectively. However, the holding members 90A to 90I may be constructed as an integrated member. Further, the holding members 90A to 90I may be supported by any member different from the first guide rail 71, and the holding members 90A to 90I may be arranged for the transport passage 65.

In the embodiment described above, the plurality of ribs 85 are provided depending on the places between the respective holding members 90A to 90I adjoining in the left-right direction 9. However, a larger number of ribs may be provided, or only one rib may be provided between the respective adjoining holding members 90A to 90I as described in the first modified embodiment.

In the embodiment described above, as shown in FIG. 6A, for example, one holding member 90A is arranged between the pair of adjacent ribs 85A and 85B. However, two or more holding members may be arranged between a pair of adjacent ribs. In this case, the two or more holding members arranged between the pair of adjacent ribs may be positioned at same position in the transport direction of the recording paper 35.

In the embodiment described above, the plurality of ribs 85A to 85T are provided between the holding members 90A to 90I arranged in the left-right direction 9. However, a plurality of holding members may be provided between a plurality of ribs arranged in the left-right direction. In this case, at least one holding member may be arranged between each pair of adjacent ribs.

In the embodiment described above, each of the holding members 90A to 90I is constructed by the base portion 91, the curved tab 92, and the holding tab 93. However, the shape of each of the holding members 90A to 90I is not limited to the shape described in the foregoing embodiment provided that the recording paper 35 can be pressed. For example, each of the holding members 90A to 90I may be constructed as a roller or a spur.

What is claimed is:

1. An image recording apparatus comprising:

a recording section that records an image on a sheet conveyed in a transport passage in a transport direction; and a corrugate mechanism including a plurality of first sheet contact members extending into the transport passage, wherein the plurality of first sheet contact members are spaced apart from one another in a widthwise direction of the transport passage perpendicular to the transport direction, wherein at least one of the first sheet contact members, provided at a central portion in the widthwise direction, is disposed at least partially upstream, in the transport direction, of all other first sheet contact members provided outside of the central portion in the widthwise direction.

2. The image recording apparatus according to claim 1, wherein each of the first sheet contact members includes a corresponding contact surface that contacts the sheet, and wherein an upstream end of the one or more contact surfaces corresponding to the at least one of the first sheet contact members, provided at the central portion in the widthwise direction, is disposed upstream, in the transport direction, of upstream ends of the one or more contact surfaces corresponding to all other first sheet contact members.

3. The image recording apparatus according to claim 1, wherein the corrugate mechanism further comprises a plurality of second sheet contact members, wherein the first sheet contact members comprises one of:

a plurality of ribs provided to support the sheet while being separated from each other in the widthwise direction of the transport passage and that abut against a lower surface of the sheet when the sheet is conveyed to the corrugate mechanism; and a plurality of holding members that are separated from each other in the widthwise direction and are disposed upstream of nozzles of the recording section in the transport direction and that abut against an upper surface of the sheet when the sheet is conveyed to the corrugate mechanism, wherein the plurality of holding members include abutment portions that abut against the sheet, at least a portion of the abutment portions being positioned lower than upper ends of the plurality of ribs, wherein the plurality of ribs include a first rib and a second rib that is provided farther from a center of the transport passage in the widthwise direction of the transport passage than the first rib, wherein the plurality of holding members include a first holding member and a second holding member that is provided farther from the center of the transport passage in the widthwise direction of the transport passage than the first holding member, wherein the second sheet contact members include another of the plurality of holding members and the plurality of ribs, and wherein the plurality of holding members are positioned between the plurality of ribs in the widthwise direction.

4. The image recording apparatus according to claim 3, wherein the plurality of holding members are arranged so that at most one holding member of the plurality of holding members is positioned between each pair of adjacent ribs among the plurality of ribs in the widthwise direction.

5. The image recording apparatus according to claim 4, wherein:

the abutment portions respectively include abutment surfaces that are capable of abutting against the sheet, the first sheet contact members include the plurality of holding members, and the plurality of holding members are disposed in a manner where an upstream end of the abutment surface of the first holding member is positioned upstream of an upstream end of the abutment surface of the second holding member in the transport direction.

6. The image recording apparatus according to claim 4, wherein:

the abutment portions respectively include abutment surfaces that are capable of abutting against the sheet; and all of the abutment surfaces and all of the ribs at least partially overlap when viewed in the widthwise direction of the transport passage.

7. The image recording apparatus according to claim 5, wherein all downstream ends of the plurality of first sheet contact members in the transport direction are positioned at a same position in the transport direction.

8. The image recording apparatus according to claim 4, wherein:

the plurality of holding members are constructed so that the abutment portions are elastically urged downward respectively, and each of the plurality of holding members press the sheet with a respective pressing force when the sheet is conveyed to the corrugate mechanism, and the respective pressing force of each of at least one holding member positioned at a central region of the transport passage in the widthwise direction is greater than the respective pressing force of each of other holding members of the plurality of holding members.

9. The image recording apparatus according to claim 4, wherein the plurality of holding members are respectively attached to a support member provided over the transport passage, and an attachment position of the first holding member is located upstream of an attachment position of the second holding member in the transport direction.

10. The image recording apparatus according to claim 4, wherein the plurality of ribs respectively have inclined portions that are inclined upwardly from upstream ends in the transport direction.

11. The image recording apparatus according to claim 3, wherein at least two ribs of the ribs are positioned between each pair of adjacent holding members of the plurality of holding members in the widthwise direction of the transport passage.

12. The image recording apparatus according to claim 1, wherein the corrugate mechanism further comprises a plurality of second sheet contact members, wherein the first sheet contact members comprise one of:

a plurality of lower abutment members spaced apart from each other in the widthwise direction and that abut against a lower surface of the sheet when the sheet is conveyed to the corrugate mechanism; and a plurality of upper abutment members spaced apart from each other in the widthwise direction and that abut against an upper surface of the sheet when the sheet is conveyed to the corrugate mechanism, wherein the plurality of lower abutment members form a corrugated shape in the sheet in conjunction with the plurality of upper abutment members, wherein the plurality of lower abutment members include a first lower abutment member and a second lower abutment member provided farther from a center of the transport passage in the widthwise direction than the first lower abutment member, wherein the plurality of upper abutment members include a first upper abutment member and a second upper abutment member provided farther from the center of the transport passage in the widthwise direction of the transport passage than the first upper abutment member, wherein the second sheet contact members include the other one of the plurality of upper abutment members and the plurality of lower abutment members, and wherein a plurality of upper abutment members are positioned between the plurality of lower abutment members in the widthwise direction.

13. The image recording apparatus according to claim 12, wherein lower ends of the plurality of upper abutment members are positioned lower than upper ends of the plurality of lower abutment members.

14. An image recording apparatus comprising:

a recording section that records an image on an upper surface of a sheet conveyed in a transport passage in a transport direction; and a plurality of holding members spaced apart from each other in a widthwise direction perpendicular to the transport direction and that press the upper surface of the sheet when the sheet is conveyed to the plurality of holding members, wherein at least one of the plurality of holding members, provided at a central portion in the widthwise direction of the transport passage, is disposed at least partially upstream of other of the plurality of holding members in the transport direction.

15. An image recording apparatus comprising:

a recording section that records an image on a sheet conveyed in a transport passage in a transport direction; and a platen provided under the recording section with the transport passage defined therebetween and that includes a plurality of ribs provided to support the sheet while being spaced apart from each other in a widthwise direction perpendicular to the transport direction, the ribs protruding upwardly and extending in the transport direction, wherein at least one of the ribs, provided at a central portion in the widthwise direction of the transport passage, is disposed at least partially upstream, in the transport direction, of other of the ribs provided outside of the central portion in the widthwise direction.

* * * * *